United States Patent [19]

Siesto

[11] 4,107,823

[45] Aug. 22, 1978

[54] BELT HOLDING CLIPS, PARTICULARLY FOR KEYS, TOOLS AND THE LIKE

[76] Inventor: Joseph T. Siesto, 8200 Bay Pkwy., Brooklyn, N.Y. 11214

[21] Appl. No.: 838,637

[22] Filed: Oct. 3, 1977

[51] Int. Cl.[2] ..... A44B 15/00

[52] U.S. Cl. ..... 24/3 K

[58] Field of Search ..... 24/3 R, 3 H, 3 J, 3 K, 24/11 R, 11 M, 256 R

[56] References Cited

U.S. PATENT DOCUMENTS

| | | | |
|---|---|---|---|
| 780,962 | 1/1905 | Perry | 24/3 J |
| 1,025,520 | 5/1912 | Douglass | 224/5 A |
| 1,042,843 | 10/1912 | Toce | 24/3 K |
| 1,295,190 | 2/1919 | Morrison | 24/3 K |
| 1,341,930 | 6/1920 | Roblin | 24/3 K |
| 1,345,357 | 7/1920 | Evans | 24/3 K |
| 1,418,979 | 6/1922 | Seferlis | 24/3 K |
| 1,477,680 | 12/1923 | Zetlin | 24/3 M |
| 1,539,220 | 5/1925 | Taylor | 24/3 K |
| 1,622,532 | 3/1927 | Morse | 24/3 K |
| 1,623,627 | 4/1927 | Lorber | 150/40 |
| 1,666,975 | 4/1928 | Monahan | 24/3 K |
| 1,729,621 | 10/1929 | Lorber | 24/3 K |
| 1,744,419 | 1/1930 | Soule | 403/182 |
| 1,829,232 | 10/1931 | Morehouse | 24/237 |
| 2,986,786 | 6/1961 | Hill | 24/3 K |
| 3,970,227 | 6/1976 | Hardy | 24/5 R |

FOREIGN PATENT DOCUMENTS 507,060 12/1954 Italy.

*Primary Examiner*—Henry S. Jaudon
*Attorney, Agent, or Firm*—Flynn & Frishauf

[57] ABSTRACT

An elongated unitary loop element of resilient material and made of an essentially flat strap is bent into a flattened loop with two overlapping end portions. The overlapping end portions overlap by a distance which is at least in the order of about of the spacing of the overlapping end portion from the opposite flattened loop side, the outer one of the overlapping end portions being formed with an angled tip extending away from the loop, the overlapping end portions being resiliently biased against each other by the material but permitting resilient deflection upon pressure against the outer one of the overlapping end portions to form an access space for removal of the key, or tool upon deflection pressure against the outer one of the overlapping end portions which will form a fulcrum over which the inner one of the end portion can tip, the overlapping end portions when undeflected, being in tight engagement, which may include an interlocking connection, to prevent removal of the key or tool and to eliminate any possible access space between said overlapping end portions.

6 Claims, 11 Drawing Figures

Fig. 1
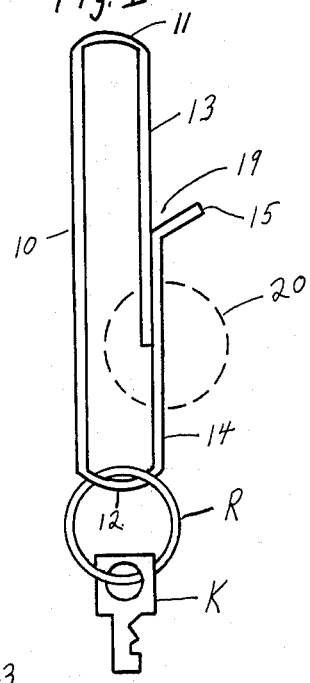
Fig. 2
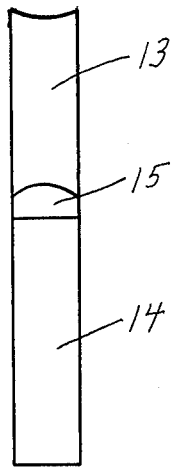
Fig. 3
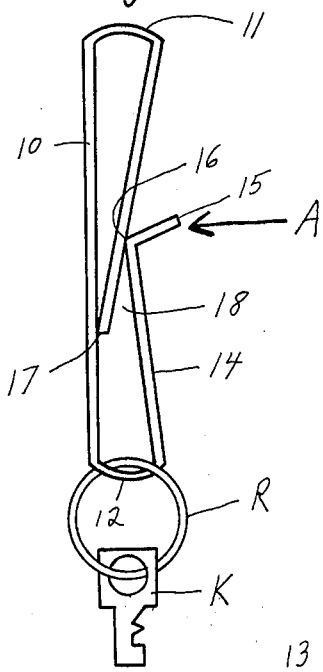
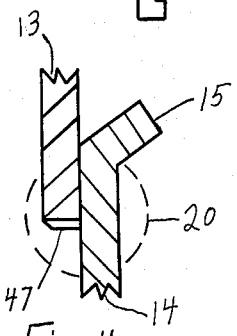
Fig. 4
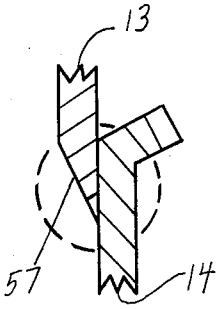
Fig. 5
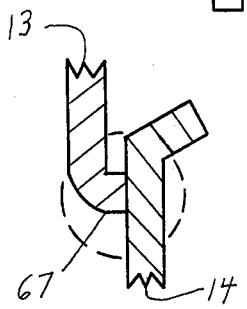
Fig. 6
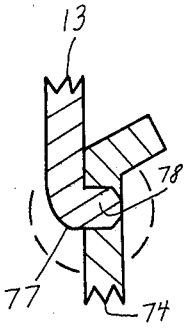
Fig. 7
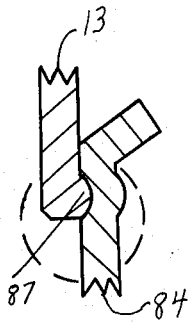
Fig. 8
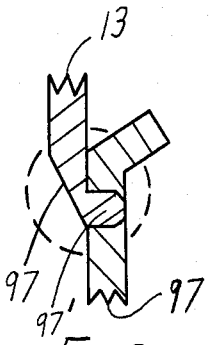
Fig. 9
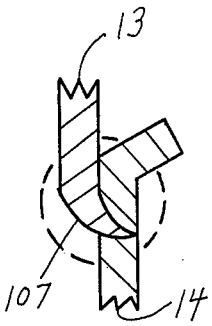
Fig. 10
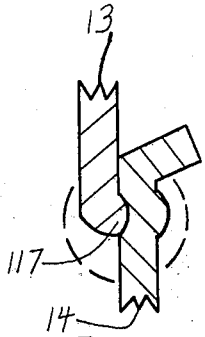
Fig. 11

BELT HOLDING CLIPS, PARTICULARLY FOR KEYS, TOOLS AND THE LIKE

The present invention relates to a belt holding clip to hold keys, tools, or the like and more particularly to a loop-shaped clip which can be threaded on a belt and which is so arranged that key rings or other holders can readily be snapped on the clip, but cannot be accidentally removed therefrom, removal being possible only by positive manipulation of the clip.

The Invention: It is an object of the present invention to provide a belt clip which is simple, inexpensive to manufacture and yet reliable in use so that accidental loss of elements threaded on the clip is effectively prevented.

Briefly, the clip is formed as an essentially elongated unitary loop element of resilient material having an essentially flat back strip portion, a pair of bent-over connecting portions extending away from the strip portions, essentially at right angles, or with rounded corners, and two end portions bent to be essentially parallel to the back strip portions to form an essentially closed, preferably flattened loop. The end portions are so arranged that they overlap each other by a distance at least in the order of about the spacing of the end portions from the back strip portion; the outer one of the overlapping end portions is formed with an angle tip extending away from the back strip portion, the bent over connecting portions resiliently biasing the end portions against each other but permitting resilient deflection upon pressure against the outer one of the overlapping end portions to permit removal of keys, tools or other attachments threaded on the clip. The junction between the angled tip of the outer one of the overlapping end portions and the respective flat part of the end portion will form a fulcrum to deflect the inner one of the end portion against the back strip portion when removal of attachments threaded on the clip is desired by forming an access space for slipping out the attachments; if the outer end portion is not deflected, however, the two overlapping end portions will be resiliently pressed against each other, completely blocking any access space for accidental removal of attachments or keys threaded on the clip.

In accordance with other embodiments of the present invention, interengaging projection and recess arrangements of the end portions with respect to each other may be used to firmly connect the end portions together and positively insure their connection and prevent separation even if considerable stress is placed on the clip.

The structure, therefore, reliably prevents accidental removal of keys, tools or other attachments threaded on the clip even if such attachments should catch on clothing of the user, during climbing, for example of utility poles, or the like and exert upward pressure against a clip, counter their weight. The attachments will slide over the junction of the overlapping end portions without catching so that accidental loss is prevented. Yet, if it is desired to remove the attachments, simple pressure on the outer end portion will provide an access space to slip them out easily.

Drawings, illustrating an example:

FIG. 1 is a side view of the belt clip used as a key ring, and showing the clip in closed condition;

FIG. 2 is a front view of the clip;

FIG. 3 is a side view of the clip showing it compressed for removal of a key;

FIG. 4 is a fragmentary sectional view, to a greatly enlarged scale, of the region within the broken-line circle of FIG. 1;

FIG. 5 is a cross section of a modification of an embodiment of the region within the circle of FIG. 1;

FIG. 6 is a cross section of another modification of the region within the circle of FIG. 1;

FIG. 7 is a cross section of another modification of the region within the circle of FIG. 1;

FIG. 8 is a cross section of another modification of the region within the circle of FIG. 1;

FIG. 9 is a cross section of another modification of the region within the circle of FIG. 1;

FIG. 10 is a cross section of another modification of the region within the circle of FIG. 1; and FIG. 11 is a cross section of another modification of the region within the circle of FIG. 1.

The clip, as basically illustrated in FIGS. 1 to 3 is a unitary element, preferable made of sheet metal, to fit over a person's belt. With the clip, keys, a pocket knife, tools and the like can be attached to the belt without danger of loss. The function of the clip is twofold: first, it secures firmly to the belt so that it cannot come off and secondly, any keys, attachments, or the like which are held by the clip will not dislodge unless it is purposely intended to remove them.

The clip has a flat back strip portion 10 from which two bent-over portions 11, 12 extend, terminating in two overlapping end portions 13, 14. A key K on a key ring R can be suspended on the clip. Suitable dimensions are, for example, a length of the back strip portion 10, and the overall lengths of the overlapping portions 13, 14, of about 7.5 cm. The widths of the material is preferably about 1 cm or slightly over; the spacing between the back strip portion and the overlapping end portions 13, 14 can be also about 1 cm, or less. The thickness of material, if made of resilient sheet metal suitably is between about ½–1 mm, for example approximately 0.8 mm.

The outer one of the overlapping end portions 14 is formed with a bent-over end forming an angled tip, extending away from the back strip portion 10. The tip 15, where bent away forms a fulcrum point 16 if the outer portion 14 is pressed inwardly by force being applied in the direction of the arrow A (FIG. 3) against the tip 15 or against the outer end portion 14. This will deflect the inner end portions 13 against the back portion 10 until its tip 17 bears against the back portion 10, forming an access space 18 between the tip 17 of the inner portion and the end portion 14 of the outer one of the two overlapping portions.

As can be seen from FIGS. 1 and 3, the bent-over portions 11, 12 preferably are somewhat rounded so that the portions 10, 13 and the portions 10, 14 each, are generally U-shaped. The particularly shape of the portions 11, 12 is not material; nor are the dimensions critical. They are suitable for the usual type of belts and to carry typical attachments such as knives, tools, or keyrings.

Under ordinary carrying conditions, that is, with a key K and a ring R in the position in FIG. 1, even upward pressure against the ring R and sliding it upwardly will not cause its removal from the clip; for removal, however, pressure is applied in accordance with arrow A (FIG. 3) which will then form a positively defined access space 18 so that, in spite of strong resilient pressure of the overlapping end portions 13, 14 against each other, the key can be readily removed. Yet, when closed, the tip end 17 of the inner end portion 13 presses against the inner surface of the outer end portion 14 so that ring R and key K cannot be removed.

The distance between the edge of the bent-over tip 15, and forming the fulcrum 16 and the lower end of the inner overlapping portions 13 should be about at least as long as the distance between the back portion 10 and any one of the overlapping portions 13, 14. The bent-over tip 15 is preferably located such that the fulcrum 16 will fall approximately midway of the length of the entire clip. The length of the tip 15 is not critical, it can be just long enough to provide access space 19 to slip a keyring R between the inner overlapping portions 13 and tip 15. Omission of tip 15 makes threading of an attachment difficult. Additionally, it facilitates deflection of the clip to the position shown in FIG. 3 for removal of element.

Various changes and modifications may be made, and several are illustrated in the detailed views of FIGS. 4 to 11, generally showing the portions within the broken circle 20 of FIG. 1.

FIG. 4 is an enlarged view and showing the end portions, to facilitate the showing, with the inner portions 13 foreshortened. The end 47 of the inner portion is tapered laterally. FIG. 5, like the other figures showing the inner portion 13 foreshortened, illustrates the inner tip 57 as being longitudinally tapered to provide a good sliding surface for a ring R, for example, if it is pulled upwardly, so that the inner surfaces of portions 13, 14, will merge smoothly. FIG. 6 illustrates a hook-shaped extension 67 on the inner portions 13, bearing, with spring pressure, against the outer portion 14. FIG. 7 illustrates an interengaging fit in which the outer portion 74, and corresponding to portion 14, is formed with an opening 78 to which the tip 77 of the inner portion 13 engages. In FIG. 8, the outer portion 84 is formed with a transverse groove, or notch punched into it into which a slightly deformed inwardly extending projection 87 of the inner portion 13 extends. FIG. 9 shows a combination of the features shown in FIGS. 5 and 7, namely an opening in the outer portion 97, a tapered surface 97 and an adjoining projection 97' formed on the inner portion 13. FIG. 10 shows a slight tapering of the inner portions 13 by deformation of the end tip 107 thereof which bites into the outer portion 14. FIG. 11 shows a punch mark or depression punched into the outer element 14 and engaged by a rounded or pointed tip end 117 of the inner portion 13, extending towards and into the depression or punch formed in the outer element.

The corners in the illustrations, for ease of understanding and presentation are shown essentially squared off. They can be rounded and, in a preferred form, all edges should be smoothly finished and burrs removed so that the element will be a unitary clip which does not have any rough edges or corners on which any attachment threaded thereon may catch.

Various changes and modifications may be made, and features described in connection with any one of the embodiments may be used with any of the others, within the scope of the inventive concept. For example, the clip can be made for suspension from another holder, swivel hook, ring, or loop attached to a suitable support, for example as a general support clip; and especially where unintended, accidental removal upon movement in a direction counter the direction of insertion is to be reliably prevented.

I claim:

1. Belt holding clip to hold attachment such as keys, tools, or the like comprising a single elongated unitary loop element of resilient material having an essentially flat back strip portion (10);

a pair of bent-over connecting portions (11, 12) extending away from the face of a back strip portion (10);

and two end portions (13, 14) bent to be essentially parallel to said back strip portion (10) to form an essentially closed loop therewith wherein, in accordance with the invention the end portions overlap each other by a distance of at least in the order of about the spacing of said end portions (13, 14) from the back strip portion (10) and at substantially the center of said back strip portion;

the outer and upwardly extending one of said overlapping end portions being formed with an angled tip (15) extending away from the back strip portion and forming therewith a first access space (19), bent-over connecting portions (11, 12) resiliently biasing the end portions (13, 14) against each other and pressing the tip end (17) of the inner end portion in engagement with the inner surface of the outer end portion (14) to prevent removal of attachments threaded on the clip, the junction between the angled tip (15) and the outer end portion (14) forming a fulcrum to permit resilient deflection of the inner one (13) of the end portions against the back strip portion (10) and generate a second access opening for removal of attachments threaded on the clip, upon application of pressure against the outer end portion (14) in a direction towards said back strip portion (10) and wherein (FIGS. 7–11) the terminal part of the tip end (77, 87, 97, 107, 117) of the inner end portion (13) and the outer one of the overlapping end portion (14) are formed with respective interengaging projection and recess means, at least the inner tip end having a finished edge.

2. Clip according to claim 1, wherein (FIG. 7) the tip end (77) of the inner end portion (13) is formed with a bent-over angled tip (77);

and the outer one of the overlapping end portion is formed with an opening (78) matching the terminal part of the tip end (77) in receiving said tip end to provide an interlocking connection therewith when the end portions are in said resilient flat overlapping engagement.

3. Clip according to claim 1, wherein (FIG. 8) the inner surface of the outer one (84) of the overlapping end portions is formed with a groove, and the tip end (87) of the inner one of the end portions (13) is formed with a matching bent-over edge fitting into the groove.

4. Clip according to claim 1, wherein (FIG. 9) the tip end (97) of the inner end portion (13) is tapered in a direction towards the outer one of the overlapping end portions to form an essentially smoothly merging surface with the inner surface of the outer overlapping end portions thereof;

and the terminal part of the tip end of the inner end portion, and the outer end portion are formed with respectively interengaging projection-and-recess means.

5. Clip according to claim 1, wherein (FIG. 11) the inner surface of the outer end portion (14) is punch-mark deformed in the region of the engagement of the tip end of the inner end portion (13);

and the tip end (117) of the inner end portion is deformed to fit into said punch-mark and to provide a pointed yet smoothly rounded projecting surface fitting into said punch-deformation.

6. Clip according to claim 1, wherein (FIG. 10) the tip end (107) of the inner portion (13) is tapered and terminates in a sharp end biting into the inner surface of the outer portion (14).

* * * * *